US010426255B2

(12) United States Patent
Xi et al.

(10) Patent No.: US 10,426,255 B2
(45) Date of Patent: Oct. 1, 2019

(54) ORAL CARE INSTRUMENT

(71) Applicant: Colgate-Palmolive Company, New York, NY (US)

(72) Inventors: Wen Jin Xi, Shanghai (CN); Fan Gang Xie, Shanghai (CN); Guang Sheng Guo, Yangzhou (CN); Cun Zhang, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 209 days.

(21) Appl. No.: 15/560,418

(22) PCT Filed: Mar. 24, 2016

(86) PCT No.: PCT/US2016/023928
§ 371 (c)(1),
(2) Date: Sep. 21, 2017

(87) PCT Pub. No.: WO2016/160490
PCT Pub. Date: Oct. 6, 2016

(65) Prior Publication Data

US 2018/0064239 A1 Mar. 8, 2018

(30) Foreign Application Priority Data

Mar. 27, 2015 (CN) ..... 2015 2 0177883 U

(51) Int. Cl.
*A46B 15/00* (2006.01)
*A46B 9/02* (2006.01)
*A46B 9/04* (2006.01)

(52) U.S. Cl.
CPC ..... *A46B 15/0081* (2013.01); *A46B 9/028* (2013.01); *A46B 9/04* (2013.01); *A46B 15/0095* (2013.01); *A46B 2200/1066* (2013.01)

(58) Field of Classification Search
CPC ..... A46B 15/0081; A46B 9/028; A46B 9/04; A46B 15/0095; A46B 2200/1066
See application file for complete search history.

(56) References Cited

U.S. PATENT DOCUMENTS 5,842,490 A 12/1998 Jensen
2004/0006837 A1 1/2004 Cann
(Continued)

OTHER PUBLICATIONS

International Search Report and the Written Opinion of the International Searching Authority issued in international application PCT/US2016/023928 dated Aug. 30, 2016.

*Primary Examiner* — Weilun Lo

(57) ABSTRACT

A toothbrush is provided that includes a base component having a gripping region and an oral engaging region defining a longitudinal axis along a length of the oral engaging region and a transverse axis along a width of the oral engaging region. The oral engaging region has bilateral symmetry with respect to the longitudinal axis and can comprise wherein the oral engaging region has bilateral symmetry with respect to the longitudinal axis and comprises a first distal region having an approximately concave contour tapering to a second middle region having an approximately convex contour and widening to a third proximal region having an approximately concave contour. The oral engaging region can support a plurality of cleaning elements along a front side and a plurality of soft cleaning elements along a second side opposite the first.

16 Claims, 3 Drawing Sheets

(56) References Cited

U.S. PATENT DOCUMENTS

| | | | | |
|---|---|---|---|---|
| 2005/0000049 | A1 | 1/2005 | Hohlbein | |
| 2005/0015901 | A1 | 1/2005 | Gavney | |
| 2006/0026784 | A1 | 2/2006 | Moskovich | |
| 2006/0052806 | A1 | 3/2006 | Xi | |
| 2006/0057087 | A1 | 3/2006 | Moskovich | |
| 2006/0090276 | A1 | 5/2006 | Sorrentino | |
| 2007/0056128 | A1* | 3/2007 | Hohlbein | A46B 9/028 15/110 |
| 2007/0101525 | A1 | 5/2007 | Hohlbein | |
| 2009/0025165 | A1 | 1/2009 | Moskovich et al. | |
| 2010/0299858 | A1 | 12/2010 | Schamber | |
| 2011/0138560 | A1* | 6/2011 | Vitt | A46B 3/22 15/167.1 |
| 2011/0289708 | A1 | 12/2011 | Jimenez | |
| 2013/0192010 | A1 | 8/2013 | Wu | |
| 2013/0269128 | A1 | 10/2013 | Jimenez | |
| 2013/0305471 | A1 | 11/2013 | Gatzemeyer | |
| 2014/0047654 | A1 | 2/2014 | Waguespack | |
| 2015/0327665 | A1 | 11/2015 | Hohlbein | |

* cited by examiner

ORAL CARE INSTRUMENT

CROSS-REFERENCE TO RELATED PATENT APPLICATIONS

This application claims the benefit of priority to Chinese Patent Application Serial No. 201520177883.3, filed Mar. 27, 2015, the entirety of which is incorporated herein by reference.

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology.

More recently, the strategic arrangement and combination of tooth cleaning elements in the form of elastomeric cleaning elements and bristle tufts has become a more common way of improving cleaning efficiency. However, very little efforts have been made to coordinate the structure and arrangement of elastomeric cleaning elements on flexible toothbrush heads formed by a plurality of segments.

Elastomeric soft tissue cleaners, which are typically located on the rear surface of the toothbrush head, have also become quite popular. However, as with the tooth cleaning elements, very little effort has been expended to coordinate the structure of the soft tissue cleaner with the structure of flexible toothbrush heads utilizing a plurality of segments.

Thus, an improved oral care instrument is needed to address these issues.

BRIEF SUMMARY

A toothbrush is disclosed that can comprises a base component comprising a gripping region, and an oral engaging region defining a longitudinal axis along a length of the oral engaging region and a transverse axis along a width of the oral engaging region; wherein the oral engaging region has bilateral symmetry with respect to the longitudinal axis and comprises a first distal region having an approximately concave contour relative to said longitudinal axis tapering to a second middle region having an approximately convex contour relative to said longitudinal axis and widening to a third proximal region having an approximately concave contour relative to said longitudinal axis; and wherein the oral engaging region supports a plurality of cleaning elements along a front side, wherein a portion of the plurality of cleaning elements are longest in length as measured from a surface of the front side of the oral engaging region at least near a distal end of the oral engaging region.

The third proximal region can have a width parallel to the transverse axis that is wider than a width parallel to the transverse axis of the first distal region. The oral engaging region can comprise a back side opposite the front side, wherein the back side comprises a plurality of soft tissue cleaning ridges. A portion of the plurality of cleaning elements can be about the same length as measured from a front surface of the first side of the oral engaging region near a distal region and a proximal region of the oral engaging region and are greater in length than a portion of the plurality of cleaning elements at a middle region. The plurality of cleaning elements can be formed in a trim profile that approximately matches a shape of a lateral side of the oral engaging region. A first portion of the plurality of cleaning elements can be arranged in a circular pattern in the first distal region and a second portion of the plurality of cleaning elements are arranged in rows in the second middle region and in the third proximal region. A width of one or more of the plurality of soft tissue cleaning ridges along the transverse axis can be approximately inversely proportional to a length of one or more of the plurality of cleaning elements at a corresponding location on the oral engaging region. The base component comprises an aperture formed near a proximal end of the toothbrush, wherein the aperture comprises a first region having a first width parallel to the transverse axis that is wider than a second region having a second width parallel to the transverse axis, wherein the second region of the aperture is located proximal to the first region of the aperture.

A toothbrush is disclosed that can comprise a base component comprising a gripping region, and an oral engaging region defining a longitudinal axis along a length of the oral engaging region and a transverse axis along a width of the oral engaging region, wherein the oral engaging region has bilateral symmetry with respect to the longitudinal axis and comprises a first distal region having an approximately concave contour relative to said longitudinal axis tapering to a second middle region having an approximately convex contour relative to said longitudinal axis and widening to a third proximal region having an approximately concave contour relative to said longitudinal axis, and wherein the oral engaging region supports a plurality of cleaning elements along a front side, wherein the plurality of cleaning elements are formed in a trim profile that approximately matches a shape of a lateral side of the oral engaging region.

The third proximal region can have a width parallel to the transverse axis that is wider than a width parallel to the transverse axis of the first distal region. The oral engaging region can comprise a back side opposite the front side, wherein the back side comprises a plurality of soft tissue cleaning ridges. A portion of the plurality of cleaning elements can be about the same length as measured from a front surface of the first side of the oral engaging region near a distal region and a proximal region of the oral engaging region and are greater in length than a portion of the plurality of cleaning elements at a middle region. A first portion of the plurality of cleaning elements can be arranged in a circular pattern in the first distal region and a second portion of the plurality of cleaning elements are arranged in rows in the second middle region and in the third proximal region. The base component can comprise an aperture formed near a proximal end of the toothbrush, wherein the aperture comprises a first region having a first width parallel to the transverse axis that is wider than a second region having a second width parallel to the transverse axis, wherein the second region of the aperture is located proximal to the first region of the aperture. The oral engaging region can comprise a back side opposite the front side, wherein the back side comprises a plurality of soft tissue cleaning ridges. A width of one or more of the plurality of soft tissue cleaning ridges along the transverse axis can be approximately inversely proportional to a length of one or more of the plurality of cleaning elements at a corresponding location on the oral engaging region.

A toothbrush is disclosed that can comprise a base component comprising a gripping region, and an oral engaging region defining a longitudinal axis along a length of the oral engaging region and a transverse axis along a width of the oral engaging region, wherein the oral engaging region has bilateral symmetry with respect to the longitudinal axis and comprises a first distal region having an approximately concave contour relative to said longitudinal axis tapering to a second middle region having an approximately convex contour relative to said longitudinal axis and widening to a third proximal region having an approximately concave contour relative to said longitudinal axis, wherein the oral engaging region supports a plurality of cleaning elements along a front side and a plurality of soft tissue cleaning ridges along a back side opposite the front side, wherein a width of one or more of the plurality of soft tissue cleaning ridges along the transverse axis are approximately inversely proportional to a length of one or more of the plurality of cleaning elements at a corresponding location on the oral engaging region.

The third proximal region can have a width parallel to the transverse axis that is wider than a width parallel to the transverse axis of the first distal region. A portion of the plurality of cleaning elements can be about the same length as measured from a front surface of the first side of the oral engaging region near a distal region and a proximal region of the oral engaging region and are greater in length than a portion of the plurality of cleaning elements at a middle region. The plurality of cleaning elements can be formed in a trim profile that approximately matches a shape of a lateral side of the oral engaging region. The base component can comprise an aperture formed near a proximal end of the toothbrush, wherein the aperture comprises a first region having a first width parallel to the transverse axis that is wider than a second region having a second width parallel to the transverse axis, wherein the second region of the aperture is located proximal to the first region of the aperture.

A toothbrush is disclosed that can comprise a base component comprising a gripping region and an oral engaging region defining a longitudinal axis along a length of the oral engaging region and a transverse axis along a width of the oral engaging region, wherein the oral engaging region supports a plurality of cleaning elements along a front side. The base component comprises an aperture formed near a proximal end of the toothbrush, wherein the aperture comprises a first region having a first width parallel to the transverse axis that is wider than a second region having a second width parallel to the transverse axis, wherein the second region of the aperture is located proximal to the first region of the aperture.

The oral engaging region can have bilateral symmetry with respect to the longitudinal axis and comprises a first distal region having an approximately convex contour tapering to a second middle region having an approximately concave contour and widening to a third proximal region having an approximately convex contour. A portion of the plurality of cleaning elements can be about the same length as measured from a front surface of the first side of the oral engaging region near a distal region and a proximal region of the oral engaging region and are greater in length than a portion of the plurality of cleaning elements at a middle region. The plurality of cleaning elements can be formed in a trim profile that approximately matches a shape of a lateral side of the oral engaging region.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
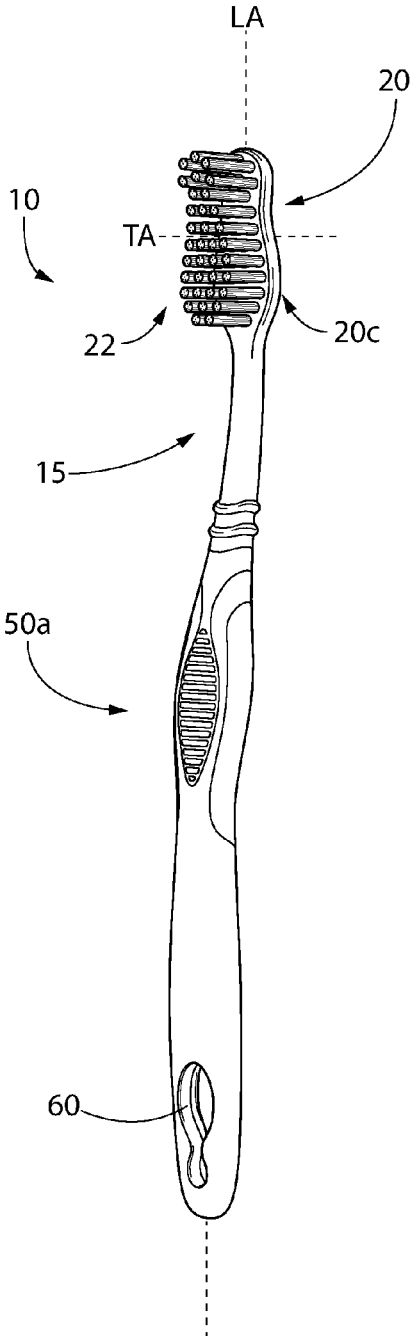
FIGS. 1A-1E illustrates a front perspective, front, rear, side, and rear-side perspective view, respectively, of an example oral care instrument, according to the present disclosure.

The following description of the preferred embodiment(s) is merely exemplary in nature and is in no way intended to limit the disclosure, its application, or uses.

The description of illustrative embodiments according to principles of the present disclosure is intended to be read in connection with the accompanying drawings, which are to be considered part of the entire written description. In the description of embodiments of the disclosure disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the preferred embodiments. Accordingly, the disclosure expressly should not be limited to such preferred embodiments illustrating some possible non-limiting combination of features that may exist alone or in other combinations of features; the scope of the disclosure being defined by the claims appended hereto.

FIGS. 1A-1E depict various views of one component, referred to herein as a first or a base component 10, used in a representative toothbrush of the disclosure, shown with reference to an imaginary longitudinal axis ("LA") and transverse axis ("TA"). A base component 10, as depicted having its length along the LA, can provide the main structure of the toothbrush and consequently the main source of some of the overall toothbrush properties such as strength, flexibility/rigidity, etc. Base component 10 may be formed from a polyolefin such as polypropylene, as discussed herein, into its desired shape by injection molding. Base component 10 may be generally elongated in shape and may have any suitable ergonomic and aesthetically pleasing configuration dimensioned to be gripped by a user. Base component 10 may be formed of one or more suitable materials conventionally used in the art for toothbrush handles including without limitation polymers, rubber, thermoplastic elastomers (TPE), and combinations thereof. Accordingly, base component 10 may be formed with many different shapes, lengths, and varieties of constructions. Base component 10 may comprise an aperture 60 from which to hang base component 10 from a support (not shown), such as a peg, when not in use. Aperture 60 may include a wider portion 55 to allow easier insertion of the support and a narrower portion 65 into which the support slides to provide a more secure placement of base component 10 on the support. Aperture 60 can have a shape that is the inverse of the shape of the oral engaging region 20.

Base component 10 may comprise one or more front and rear gripping regions 50*a* and 50*b*, respectively, which may be regions that are normally gripped or held by the user. Base component 10 may also comprise an oral engaging region 20, which may be a region that is normally fabricated with cleaning elements 22, such as bristle tufts that are applied to the user's teeth. A neck 15 may separate and extend between gripping regions 50*a*, 50*b* and oral engaging region 20 and may be inclined or angled relative to (e.g., not collinear with) the gripping regions 50*a*, 50*b* and/or the oral engaging region 20. For example, the oral engaging region 20 may be inclined (i.e., offset from the formation of a straight line) at an angle from about 5° to about 40° relative to gripping regions 50*a*, 50*b* or the rear segment of base component 10. Base component 10 may be arranged in a multi-curvature configuration, such that the area near gripping region 50*a* may be at or near an apex of a convex arc and the area near gripping region 50*b* may be at or near a bottom of a concave arc. By way of another example, the portion of base component 10 near the aperture 60 can be offset from the oral engaging region 20 along the longitudinal axis, such that when the toothbrush is placed onto a support (not shown) through aperture 60 in a vertical orientation, the oral engaging region 20 would likely not be in contact with a vertical wall or surface, and thus may help prevent contamination of the oral engaging region 20 from those surfaces.

Oral engaging region 20 can be integrally formed with base component 10 in certain embodiments of the disclosure thereby forming a single unitary structure. In some embodiments, an injection molding, milling, machining or other suitable process can be used to integrally form the oral engaging region 20 and the base component 10, as is known in the art. However, in other embodiments, base component 10 and oral engaging region 20 may be formed as separate components which are operably connected at a later stage of the manufacturing process by any suitable technique known in the art, including without limitation thermal welding, a tight-fit assembly, a coupling sleeve, adhesion, or fasteners. Whether oral engaging region 20 and base component 10 are of a unitary or multi-piece construction (including connection techniques) is not limiting of the present disclosure in all embodiments. In some examples, oral engaging region 20 may be removably attached to base component 10, such that an oral engaging region 20 may be removed and replaced or exchanged for a different one.

Oral engaging region 20 may include a front brushing side 20*a*, an opposing rear side 20*b*, two opposing lateral sides 20*c*, 20*d*, a distal end 20*e*, and a proximal end 20*f* closest to neck 15. Primary oral care region is defined on the front brushing side 20*a* between the lateral sides 20*c* and 20*d*, the distal end 20*e*, and the proximal end 20*f*. In some embodiments, the rear side 20*b* may define a secondary oral care region supporting one or more soft tissue cleaning elements 35. While FIGS. 1C-1E show the one or more soft tissue cleaning elements 35 as a plurality of arcuate projections of varying curvature, it will be understood that other constructions and configurations may be used as desired. Oral engaging region 20 may have a variety of shapes as discussed further below. The front brushing side 20*a* and opposing lateral sides 20*c* and 20*d* of oral engaging region 20 can take on a wide variety of shapes and contours, none of which are limiting of the present disclosure. For example, the shapes can be planar, contoured or combinations of the two. Neck 15 may be narrower in width than oral engaging region 20 and tapered to smoothly transition from oral engaging region 20 into the rear portion of base component 10.

Figure 1B:
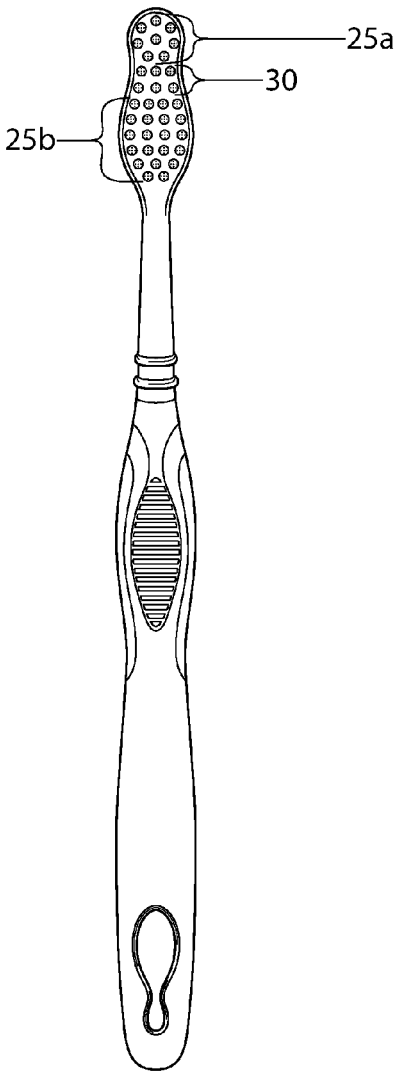
Figure 1C:
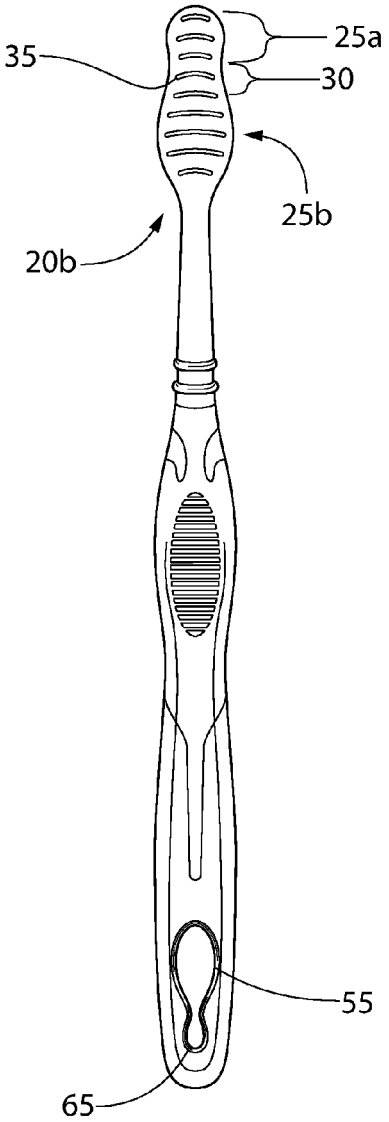
Figure 1D:
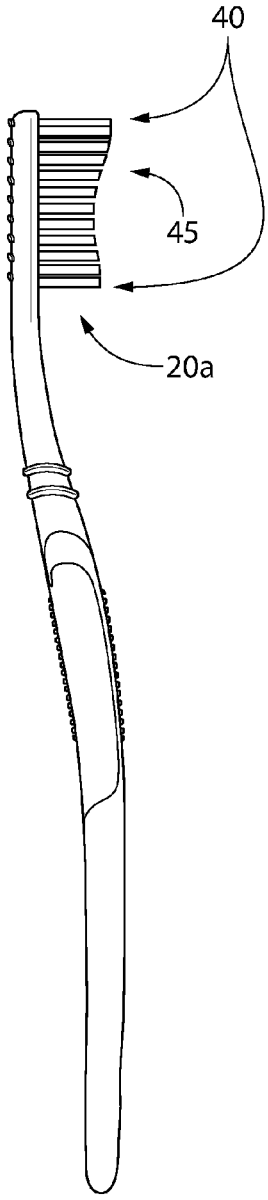
Figure 1E:
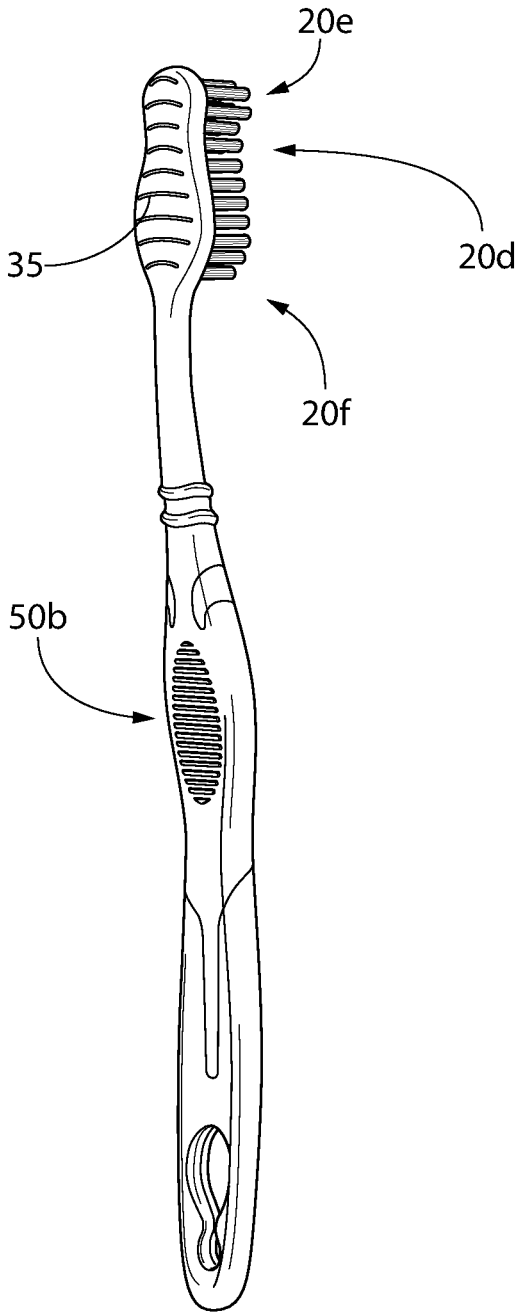

As shown in FIGS. 1B and 1C, oral engaging region 20 can be formed to have bilateral symmetry with respect to the longitudinal axis. Oral engaging region 20 can comprises a first distal region 25*a* having an approximately concave contour relative to the longitudinal axis tapering to a second middle region 30 having an approximately convex contour relative to the longitudinal axis and widening to a third proximal region 25*b* having an approximately concave contour relative to the longitudinal axis. By way of a non-limiting example, oral engaging region 20 may comprise a first distal region 25*a* having a circular shape or an approximately circular shape, such as an elliptical shape in which the two foci of the ellipse are very near to each other, such as within 1.5 mm or less of each other. The distal region 25*a* may taper to a second middle region 30 and widen to a third proximal region 25*b* having an elliptical shape or an approximately elliptical shape, such as an oval shape, an oval shape with one axis of symmetry or an egg shape. The topmost or first distal region 25*a* can have a width or diameter or semi-minor axis length that is greater than the width of the second middle region 30 and less than the width or semi-minor axis length or axis-of-non-symmetry length of the third proximal region 25*b*, resulting in an overall "number 8" or "peanut shell" shape of the oral engaging region 20 when viewed from the front (FIG. 1B) or rear (FIG. 1C).This shape can allow greater access for cleaning elements 22 to reach the rear-most teeth of the user.

The primary oral care area of oral engaging region 20 (e.g., the front brushing side 20*a*) can support a plurality and variety of cleaning elements 22, which extend from oral engaging region 20. Cleaning elements 22 may include a variety of bristle and elastomeric elements.

As shown best in FIG. 1D, the cleaning elements 22 can be formed to have a trim profile with a curved contour that mirrors, mimics, or approximately matches the contour of the oral engaging region 20, for example by appropriately varying the lengths of the bristles that make up the cleaning elements 22. In various embodiments, cleaning elements 22 may vary in length such that a portion of the cleaning elements 22 are longer in length at the distal and proximal ends of oral engaging region 20, where oral engaging region 20 is relatively narrow, such as in the first distal region 25*a* and/or third proximal region 25*b* (indicated by reference number 40 in FIG. 1D), and a portion of the cleaning elements 22 are shorter near the center of oral engaging region, such as middle region 30 (indicated by reference number 45). In some examples, cleaning elements 22 may have this contour shape and trim profile, while oral engaging region 20 is shaped in an elongated elliptical or oval manner.

In one embodiment, cleaning elements 22 may be formed of a thermoplastic elastomer ("TPE"). Other suitable elastomeric materials include any biocompatible resilient material suitable for uses in an oral hygiene apparatus. To provide optimum comfort as well as cleaning benefits, the elastomeric material preferably has a hardness property in the range of A10 to A40 Shore hardness, and preferably A25 Shore hardness. In some embodiments, different portions of the cleaning elements 22 may have different hardnesses. One preferred elastomeric material is styrene-ethylene/butylene-styrene block copolymer (SEBS) manufactured by GLS Corporation. Nevertheless, SEBS material from other manufacturers or other materials within and outside the noted hardness range could be used.

While the plurality of cleaning elements 22 is particularly suited for brushing teeth, the plurality of cleaning elements 22 can also be used to clean other surfaces of the oral cavity if desired. As used herein, the term "cleaning element" is used in a generic sense to refer to any structure that can be used to clean or massage an oral surface through relative surface contact. Common examples of "cleaning elements" include, without limitation, filament bristles, fiber bristles, nylon bristles, spiral bristles, rubber bristles, elastomeric protrusions, flexible polymer protrusions, co-extruded filaments, flag bristles, crimped bristles, anti-bacterial bristles and combinations thereof and/or structures containing such materials or combinations. Cleaning elements 22 described herein may be attached to oral engaging region 20 by any suitable conventional method used in the art such as, without limitation for example, anchor free tufting (AFT), in mold tufting, anchor/staple, injection molding, ultrasonic welding, and combinations thereof.

Soft tissue cleaning elements 35 may be used to treat areas of the mouth other than the teeth; they are primarily intended for use as a tongue cleanser and will be described herein as such for purposes of convenience. As shown best in FIGS. 1C-1E, the tongue cleanser may include a plurality of projections 35 that can be used to scrape or otherwise cleanse the tongue and other soft tissue of the mouth (e.g., the inner surfaces of the cheeks). In the present disclosure, each of the projections is formed by a combination of hard and soft materials to provide the beneficial effects of superior cleaning of the tongue (or other soft tissue) with comfort and safety from injury. A plurality of projections 35 can be formed of the same material as oral engaging region 20 or can be formed of a different material that is either softer or harder than the material of the oral engaging region 20. In some example, the plurality of projections 35 can have a base portion (not shown) formed of the same material as oral engaging region 20 and an end portion (not shown) of a different material than the base that is either harder or softer than the base portion. In some examples, the plurality of projections 35 may have varying widths, such that various projections may be wider where oral engaging region 20 is widest and others may be narrow where oral engaging region is narrower. By way of one example, a width of one or more of the plurality of soft tissue cleaning ridges along the transverse axis are approximately inversely proportional to a length of one or more of the plurality of cleaning elements at a corresponding location on the oral engaging region. As shown in FIGS. 1C and 1D, the width of the soft tissue cleaning elements 35 at or about the location indicated by the arrow of the third proximal region 25*b* corresponds to a bristle length that is less than the bristle length at either the first distal region 25*a* and/or the third proximal region 25*b*.

In some examples, the above-described aspects may be practiced or incorporated into a manual toothbrush or a powered toothbrush. While the disclosure has been described with respect to specific examples including presently preferred embodiments and modes of carrying out the disclosure, those skilled in the art will appreciate that numerous variations and permutations are possible. It is to be understood that other embodiments may be utilized and structural and functional modifications may be made without departing from the scope of the present disclosure. Thus, the spirit and scope of the disclosure should be construed broadly as set forth in the appended claims.

The devices and apparatuses described herein utilize conventional, commercially-available components which will be readily known to and obtainable by those skilled in the art. Therefore, it is well within ambit of those skilled in the art to assemble such components to create these devices and to employ the methods described herein for the detection and treatment of oral conditions related to the presence of bacteria or bacterial metabolic products without undue experimentation.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the preferred embodiments of the present disclosure, it will be understood that various additions, modifications and substitutions may be made therein without departing from the spirit and scope of the present invention as defined in the accompanying claims. In particular, it will be clear to those skilled in the art that the present disclosure may be embodied in other specific forms, structures, arrangements, proportions, sizes, and with other elements, materials, and components, without departing from the spirit or essential characteristics thereof. One skilled in the art will appreciate that the disclosure may be used with many modifications of structure, arrangement, proportions, sizes, materials, and components and otherwise, used in the practice of the disclosure, which are particularly adapted to specific environments and operative requirements without departing from the principles of the present disclosure. The presently disclosed embodiments are therefore to be considered in all respects as illustrative and not restrictive, the scope of the disclosure being defined by the appended claims, and not limited to the foregoing description or embodiments.

What is claimed is:

1. A toothbrush comprising:

a base component comprising a gripping region, and an oral engaging region defining a longitudinal axis along a length of the oral engaging region and a transverse axis along a width of the oral engaging region;

wherein the oral engaging region has a front side, the oral engaging region having bilateral symmetry with respect to a plane extending along the longitudinal axis perpendicular to the front side of the oral engaging region and comprises a distal region having an outer surface with a convex contour, the distal region gradually tapering to a middle region having an outer surface with a concave contour, the middle region gradually widening to a proximal region having an outer surface with a convex contour;

wherein a plurality of cleaning elements extend from the front side of the oral engaging region, wherein a portion of the plurality of cleaning elements are longest in length as measured from the front side to the oral engaging region at least near a distal end of the oral engaging region; and wherein the plurality of cleaning elements are formed in a trim profile that approximately matches a shape of a lateral side of the oral engaging region such that a length of the plurality of cleaning elements in the distal and proximal regions is greater than a length of the plurality of cleaning elements in the middle region, the plurality of cleaning elements gradually decreasing in length from the distal end and a proximal end of the oral engaging region towards the middle region.

2. The toothbrush of claim 1, wherein the proximal region has a width parallel to the transverse axis that is wider than a width parallel to the transverse axis of the distal region.

3. The toothbrush of claim 1, wherein the oral engaging region comprises a back side opposite the front side, wherein the back side comprises a plurality of soft tissue cleaning ridges.

4. The toothbrush of claim 1, wherein a first portion of the plurality of cleaning elements are arranged in a circular pattern in the distal region and a second portion of the plurality of cleaning elements are arranged in rows in the middle region and in the proximal region.

5. The toothbrush of claim 3, wherein a width of one or more of the plurality of soft tissue cleaning ridges along the transverse axis are approximately inversely proportional to a length of one or more of the plurality of cleaning elements at a corresponding location on the oral engaging region.

6. The toothbrush of claim 1, wherein the base component comprises an aperture formed near a proximal end of the toothbrush.

7. The toothbrush of claim 6, wherein the aperture comprises a first region having a first width parallel to the transverse axis that is wider than a second region having a second width parallel to the transverse axis, wherein the second region of the aperture is located proximal to the first region of the aperture.

8. A toothbrush comprising:

a base component comprising a gripping region, and an oral engaging region defining a longitudinal axis along a length of the oral engaging region and a transverse axis along a width of the oral engaging region, wherein the oral engaging region has a front side, the oral engaging region having bilateral symmetry with respect to a plane extending along the longitudinal axis perpendicular to the front side of the oral engaging region and comprises a distal region having an outer surface with a convex contour, the distal region gradually tapering to a middle region having an outer surface with a concave contour, the middle region gradually widening to a proximal region having an outer surface with a convex contour, and wherein a plurality of cleaning elements extend from the front side of the oral engaging region, wherein the plurality of cleaning elements are formed in a trim profile that approximately matches a shape of a lateral side of the oral engaging region such that a length of the plurality of cleaning elements in the distal and proximal regions is greater than a length of the plurality of cleaning elements in the middle region, the plurality of cleaning elements gradually decreasing in length from the distal end and a proximal end of the oral engaging region towards the middle region.

9. The toothbrush of claim 8, wherein the proximal region has a width parallel to the transverse axis that is wider than a width parallel to the transverse axis of the distal region.

10. The toothbrush of claim 8, wherein a portion of the plurality of cleaning elements are of about the same length as measured from the front side of the oral engaging region near the distal region and the proximal region of the oral engaging region and are greater in length than a portion of the plurality of cleaning elements at the middle region.

11. The toothbrush of claim 8, wherein a first portion of the plurality of cleaning elements are arranged in a circular pattern in the distal region and a second portion of the plurality of cleaning elements are arranged in rows in the middle region and in the proximal region.

12. The toothbrush of claim 8, wherein the base component comprises an aperture formed near a proximal end of the toothbrush, wherein the aperture comprises a first region having a first width parallel to the transverse axis that is wider than a second region having a second width parallel to the transverse axis, wherein the second region of the aperture is located proximal to the first region of the aperture.

13. The toothbrush of claim 8, wherein the oral engaging region comprises a back side opposite the front side, wherein the back side comprises a plurality of soft tissue cleaning ridges.

14. The toothbrush of claim 13, wherein a width of one or more of the plurality of soft tissue cleaning ridges along the transverse axis are approximately inversely proportional to a length of one or more of the plurality of cleaning elements at a corresponding location on the oral engaging region.

15. A toothbrush comprising:

a base component comprising a gripping region, and an oral engaging region defining a longitudinal axis along a length of the oral engaging region and a transverse axis along a width of the oral engaging region, wherein the oral engaging region has a front side, the oral engaging region having bilateral symmetry with respect to a plane extending along the longitudinal axis perpendicular to the front side of the oral engaging region and comprises a distal region having an outer surface with a convex contour, the distal region gradually tapering to a middle region having an outer surface with a concave contour, the middle region gradually widening to a proximal region having an outer surface with a convex contour, wherein a plurality of cleaning elements extend from the front side of the oral engaging region and a plurality of soft tissue cleaning ridges are positioned along a back side opposite the front side, wherein a width of one or more of the plurality of soft tissue cleaning ridges along the transverse axis are approximately inversely proportional to a length of one or more of the plurality of cleaning elements at a corresponding location on the oral engaging region; and wherein the plurality of cleaning elements are formed in a trim profile that approximately matches a shape of a lateral side of the oral engaging region such that a length of the plurality of cleaning elements in the distal and proximal regions is greater than a length of the plurality of cleaning elements in the middle region, the plurality of cleaning elements gradually decreasing in length from the distal end and a proximal end of the oral engaging region towards the middle region.

16. The toothbrush of claim 15, wherein the proximal region has a width parallel to the transverse axis that is wider than a width parallel to the transverse axis of the distal region.

* * * * *